United States Patent [19]

Arlauskas

[11] 4,446,596

[45] May 8, 1984

[54] DOOR HINGE AND HOLD OPEN

[75] Inventor: Alfonsas Arlauskas, Troy, Mich.

[73] Assignee: General Motors Corporation, Detroit, Mich.

[21] Appl. No.: 369,587

[22] Filed: Apr. 19, 1982

[51] Int. Cl.[3] ..... E05D 11/10

[52] U.S. Cl. ..... 16/333; 16/334; 16/347; 16/DIG. 36

[58] Field of Search ..... 16/333, 345, 334, 344, 16/352, 374, DIG. 36, 347, 332, 343; 267/20 R, 179, 174

[56] References Cited

U.S. PATENT DOCUMENTS

| | | | |
|---|---|---|---|
| 2,700,788 | 2/1955 | Hennelly | 267/179 X |
| 2,812,535 | 11/1957 | Ragsdale | 16/140 |
| 2,990,569 | 7/1961 | Pollak | 16/146 |

FOREIGN PATENT DOCUMENTS

| | | | |
|---|---|---|---|
| 1410827 | 10/1975 | United Kingdom | 353/16 |

*Primary Examiner*—Mark Rosenbaum
*Assistant Examiner*—Joseph M. Gorski
*Attorney, Agent, or Firm*—Herbert Furman

[57] ABSTRACT

A door hinge and hold open which includes generally U-shaped male and female hinge members having the legs thereof pivotally secured to each other. The hold open lever is pivoted to one of the legs of the male hinge member and biased into engagement with a detent roller on a respective leg of the female hinge member by a compression spring seating between the base of the male hinge member and a spring retainer generally traversing the legs of the male hinge member and having one side thereof engaging the hold open lever and the other side thereof engaging the other leg of the male hinge member.

3 Claims, 5 Drawing Figures

DOOR HINGE AND HOLD OPEN

This invention relates generally to a vehicle body door hinge and hold open and more particularly to a vehicle body door hinge and hold open of the type which includes a spring biased lever on one hinge member engageable with a detent roller on the other hinge member to delineate the hold open position of the one member relative to the other member.

Vehicle body door hinges of this general type are known in the prior art and reference may be had to Ragsdale U.S. Pat. No. 2,812,535 and Pollak U.S. Pat. No. 2,990,569 for such prior art structures. The hinge and hold open of this invention differs from such prior art structures in that it includes a compression spring which seats on the base of one hinge member between the legs thereof and is operatively connected to the hold open lever by a spring retainer which extends transversely of the one hinge member between the hold open lever and one leg of the one hinge member. By thus arranging the spring and the hold open lever, a more compact hinge assembly can be obtained and a lesser rate spring can be utilized while still obtaining the required spring force on the hold open lever to hold the one hinge member in a hold open position despite the weight of the vehicle door.

It is therefore a primary object of this invention to provide an improved vehicle body door hinge and hold open wherein a hold open lever on one hinge member is biased into engagement with a detent roller on the other hinge member by a compression spring exerting its force generally centrally of the one hinge member and operatively connected to the hold open lever by a retainer which traverses the one hinge member and is connected between the hold open lever and the one hinge member.

This and other objects of the invention will be readily apparent from the following specification and drawings wherein.

Figure 1:
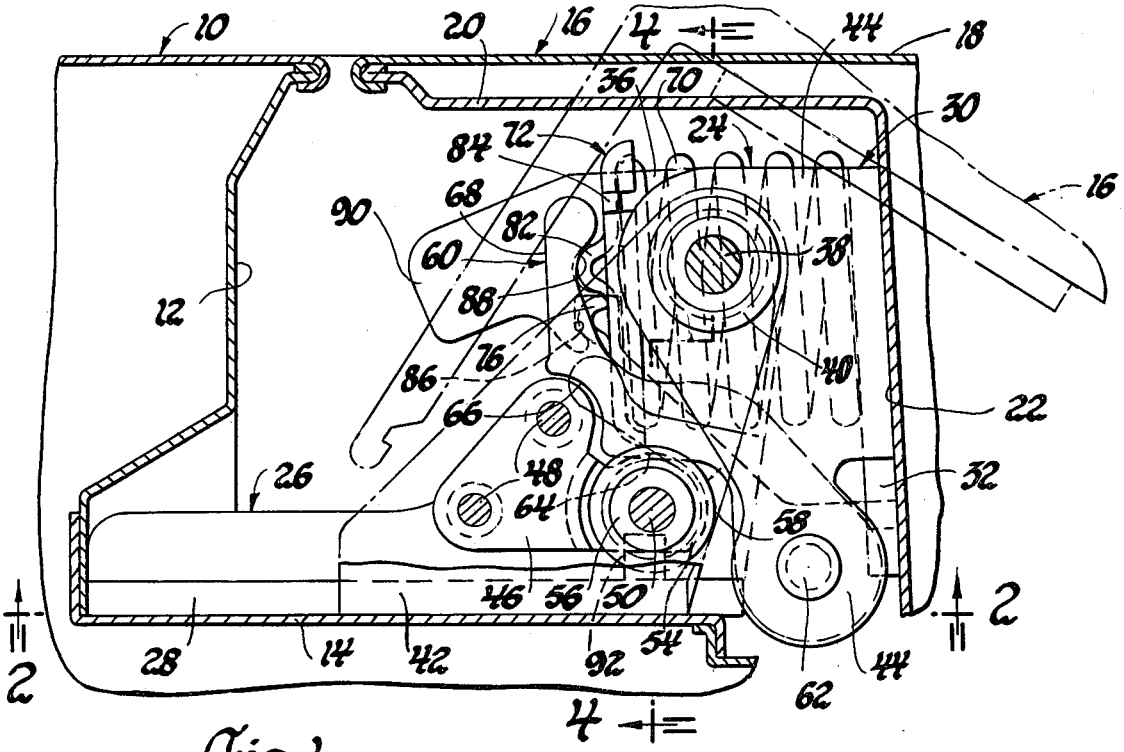
FIG. 1 is a partial sectional view of a vehicle body having a door mounted thereon by a hinge and hold open according to this invention, with the door being shown in full lines in closed position and in dash lines in fully open position.

Referring now particularly to FIG. 1, a vehicle body designated generally 10 includes a front door opening 12 having a vertically extending outwardly facing hinge pillar wall 14. A vehicle body door designated generally 16 includes an outer panel 18 and an inner panel 20 having a forwardly facing wall 22. The door 16 is mounted on the wall 14 by a hinge and hold open designated 24 according to this invention.

The hinge and hold open includes a generally U-shaped female or body hinge member 26 having its base 28 mounted in a suitable manner, such as by welding or bolting, to the wall 14. A generally U-shaped male or door hinge member 30 has its base 32 likewise secured in a suitable manner such as by welding or bolting to the door wall 22. As best shown in FIG. 4, the lower leg 34 of hinge member 26 and the lower leg 36 of hinge member 30 are pivotally secured to each other by a headed over shouldered rivet 38 and a shouldered bushing 40. The upper leg 42 of hinge member 26 and the upper leg 44 of the hinge member 30 are likewise secured to each other by the same rivet 38 and bushing 40, with the rivets and bushings being arranged coaxially of each other and defining the hinge axis of the hinge members. Thus the hinge members 26 and 30 pivotally mount the door 16 on the body 10 for counterclockwise sequential swinging movement of the former relative to the latter between a closed position shown in full lines in FIG. 1, and intermediate open position shown in full lines in FIG. 3, and a fully open position shown in dash lines in FIG. 1.

An angularly offset sheet metal bracket 46 has an upper leg riveted at 48 to the upper leg 42 of hinge member 26. A headed pin 50 is driven through an opening 52, FIG. 4, in the upper leg 42 of hinge member 26 and also through an opening in an apertured lower leg 54 of bracket 46, with the pin being retained by integral splines thereof engaging the wall of the opening 52 as shown in FIG. 4. A shouldered bushing 56 is received on the pin 50 and rotatably mounts a detent roller 58 thereon.

Figure 2:
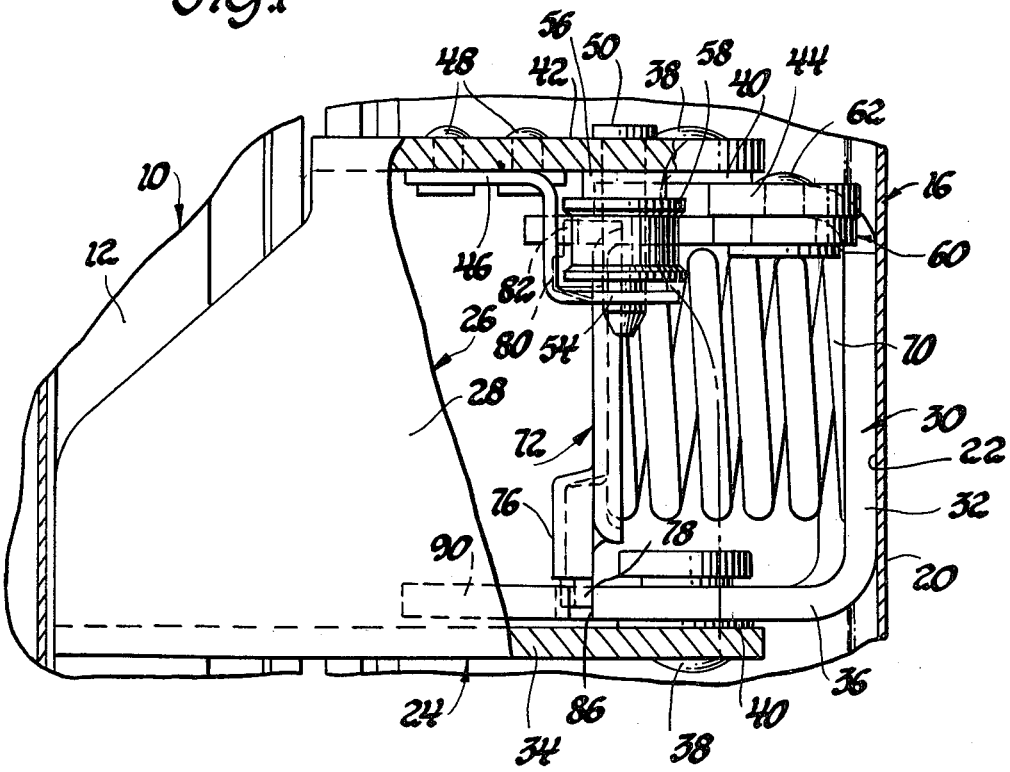
FIG. 2 is a partial broken away view taken generally along the plane indicated by line 2—2 of FIG. 1.
Figure 5:
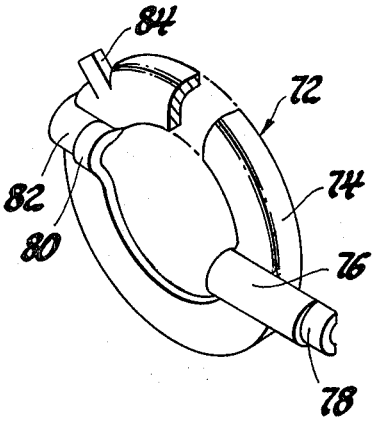
FIG. 5 is a partial broken away perspective view of the retainer.

A hold open lever 60 is pivoted at 62 to the upper leg 44 of the hinge member 30. The hold open lever 60 includes an inwardly facing edge having a linear edge portion 64, a hold open or detent shoulder 66 and a second linear edge portion 68 which are sequentially engageable with the reduced diameter center portion of detent roller 58 in the fully closed, intermediate, and fully open positions of door 16 relative to body structure 10 as will be described. A coil compression spring 70 has one end thereof seating on the base 32 of hinge member 30 intermediate legs 36 and 44 as best shown in FIG. 2. The force of the spring is directed centrally of the hinge member between the legs thereof and transversely of the hinge axis. The other end of the spring 70 seats on a generally circular spring retainer 72, the details of which are best shown in FIG. 5. The spring retainer 72 includes a generally semi-circular or arcuate cross-section rim 74 which receives and seats the last coil of the other end of the spring 70. A first semi-circular linear rib 76 is coined from the material of the retainer and includes a reduced diameter rib portion or extension 78. A second semi-circular linear rib 80 is also coined from the material of the retainer and includes a reduced diameter rib portion 82 which wraps around the rim 74. The retainer also includes a lanced radially extending tab 84. Ribs 76 and 80 are parallel to each other and to a diameter of rim 74 and also located on opposite sides of such diameter.

Figure 3:
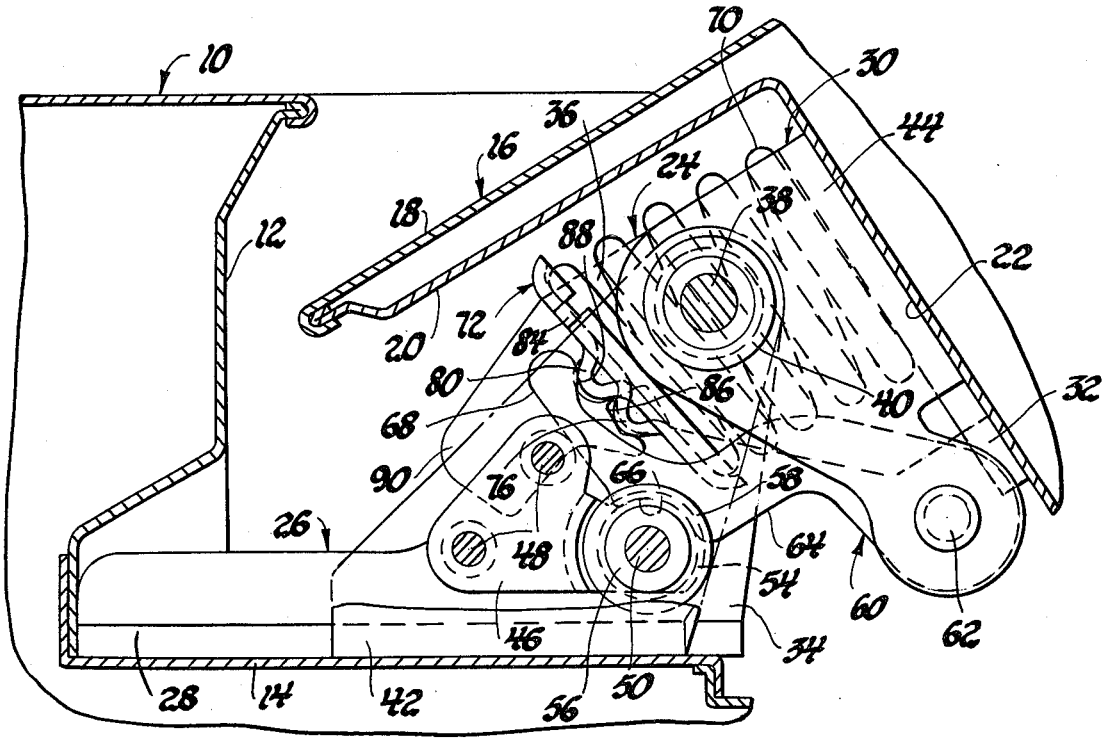
FIG. 3 is a view showing the door in an intermediate open position.
Figure 4:
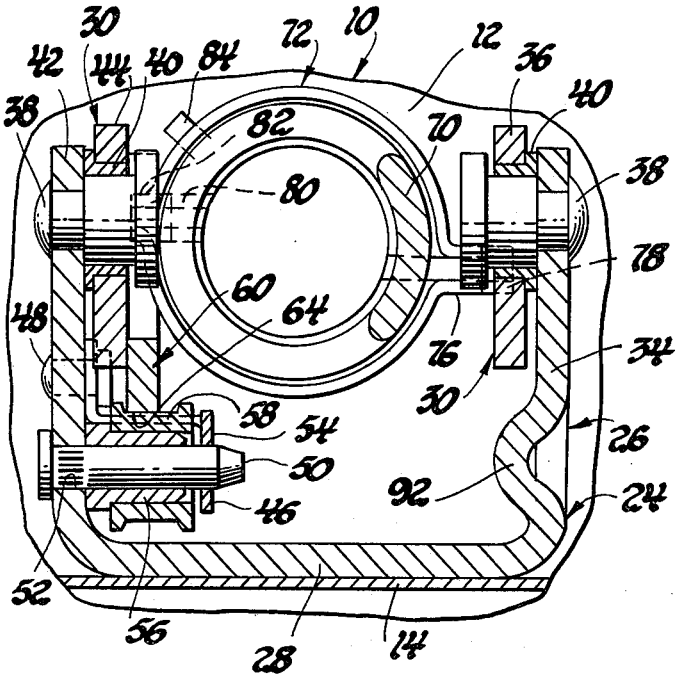
FIG. 4 is a sectional view taken generally along the plane indicated by line 4—4 of FIG. 1.

The retainer 72 extends generally transversely between the legs 44 and 36 of the hinge member 30 as shown in FIG. 2 with the reduced diameter rib portion 78 of rib 76 being received in a notch 86 in the lower leg 36 of the hinge member 30 as shown in FIGS. 1 and 3. The reduced diameter rib portion 82 of the rib 80 bears against an arcuate shoulder 88 of the outwardly facing edge of the lever 60. It can be seen that the spring 70 thus exerts a bias between the lever 60 and the leg 36 of the hinge member 30 tending to rotate the lever 60 counterclockwise about the pivot 62 and hold the inwardly facing edge of the lever in engagement with the detent roller 58.

When the door 16 is in closed position as shown in full lines in FIG. 1, the linear edge portion 64 of lever 60 engages the detent roller 58. Since this edge portion tangentially engages the roller and the axial force of the spring is generally parallel to the linear edge portion, as shown in FIG. 1, there is no hold open action resulting from this engagement. When the door 16 is moved to the intermediate open position shown in full lines in FIG. 3, the relative movement between the hinge members 26 and 30 engages the arcuate detent shoulder 66 of the lever 60 with the detent roller 58 to thereby releasably hold the door 16 in this position against the force of gravity and the inclination of the hinge axis tending to return the door to the closed position. In this position of lever 60, the axial force of the spring approaches the axis of the detent roller but the spring is less compressed than in the door closed position.

Upon movement of the door to the fully open position shown in dash lines in FIG. 1, the linear edge portion 68 of the lever 60 tangentially engages the roller 58 as an extension 90 of the lower leg 36 of hinge member 30 engages an edge of a lanced upwardly offset bump or shoulder 92 of the lower leg 34 of hinge member 26, FIG. 4, to provide a positive stop delineating the fully open position of the door 16. There is no hold open action in this position of the door since the edge portion 68 tangentially engages roller 58 and the spring is least compressed.

Upon closing movement of the door from the fully open position, it will be understood that the lever 60 moves relative to the roller 58 and that the detent shoulder 66 and subsequently the edge portion 64 sequentially engage the roller during movement of the door from the fully open position to the intermediate open position and finally to the fully closed position.

Thus this invention provides an improved vehicle body door hinge and hold open.

The embodiments of the invention in which an exclusive property or privilege is claimed are defined as follows:

1. A door hinge and hold open comprising, in combination, a first hinge member having a base and laterally spaced first and second legs, a second hinge member having a base and laterally spaced first and second legs, each juxtaposed to a respective first and second leg of the first hinge member and pivotally secured thereto for movement of the second hinge member relative to the first hinge member between open and closed positions, a hold open lever located immediately adjacent to the first leg of the second hinge member and including an edge portion provided with at least one detent shoulder, means pivotally securing the lever to the first leg of the second hinge member, a follower on the first leg of the first hinge member engageable with the edge portion of the lever and a detent shoulder of the lever during relative movement of the hinge members to releasably locate the second hinge member in open position, an annular spring mount extending between the second leg of the second hinge member and the hold open lever, peripherally spaced rib means on the spring mount, shoulder means on the second leg of the second hinge member and on the hold open lever releasably respectively engaged by the rib means, and spring means extending between the base of the second hinge member and the spring mount exerting a bias on the spring mount to seat the rib means and shoulder means and bias the edge portion of the lever and the detent shoulder into engagement with the follower.

2. A door hinge and hold open comprising, in combination, a first hinge member having a base and laterally spaced first and second legs, a second hinge member having a base and laterally spaced first and second legs, each juxtaposed to a respective first and second leg of the first hinge member and pivotally secured thereto for movement of the second hinge member relative to the first hinge member between open and closed positions, a hold open lever located immediately adjacent to the first leg of the second hinge member and including an edge portion provided with at least one detent shoulder, means pivotally securing the lever to the first leg of the second hinge member, a follower on the first leg of the first hinge member engageable with the edge portion of the lever and a detent shoulder of the lever during relative movement of the hinge members to releasably locate the second hinge member in open position, an annular spring mount extending between the second leg of the second hinge member and the hold open lever, spaced means on the spring mount respectively releasably engageable with the second leg of the second hinge member and with the hold open lever, and spring means extending between the base of the second hinge member and the spring mount and exerting a bias on the spring mount to maintain the releasable engagement of the spaced means on the spring mount with the second hinge member and lever and bias the edge portion of the lever and the detent shoulder into engagement with the follower.

3. A door hinge and hold open comprising, in combination, a first hinge member having a base and laterally spaced first and second legs, a second hinge member having a base and laterally spaced first and second legs, each juxtaposed to a respective first and second leg of the first hinge member and pivotally secured thereto for movement of the second hinge member relative to the first hinge member between open and closed positions, a hold open lever located immediately adjacent to the first leg of the second hinge member and including an edge portion provided with at least one detent shoulder, means pivotally securing the lever to the first leg of the second hinge member, a follower on the first leg of the first hinge member engageable with the edge portion of the lever and a detent shoulder of the lever during relative movement of the hinge members to releasably locate the second hinge member in open position, a generally circular spring mount extending between the second leg of the second hinge member and the hold open lever and including a pair of radially extending ribs, a shoulder on the second leg of the second hinge member and on the hold open lever releasably engaged by a respective one of the ribs, and spring means extending between the base of the second hinge member and the spring mount and exerting a bias on the spring mount to maintain the ribs and shoulder releasably engaged and bias the edge portion of the lever and the detent shoulder into engagement with the follower.

* * * * *